US005971458A

United States Patent [19]

Contreras et al.

[11] Patent Number: 5,971,458

[45] Date of Patent: Oct. 26, 1999

[54] CLOTHING CARRIER

[76] Inventors: Thomas J. Contreras, 1512 N. 14th Ave., Melrose Park, Ill. 60161; David G. Midlick, 5815 Oakwood Dr. Apt. F, Lisle, Ill. 60532

[21] Appl. No.: 09/170,292

[22] Filed: Oct. 13, 1998

[51] Int. Cl.[6] ..... A45C 13/26; B65D 69/00

[52] U.S. Cl. ..... 294/150; 294/153; 294/156

[58] Field of Search ..... 294/31.2, 74, 137, 294/141–143, 148–150, 153, 154, 156, 165, 168, 170; 223/85, 88; 224/927

[56] References Cited

U.S. PATENT DOCUMENTS

| | | | |
|---|---|---|---|
| 3,554,417 | 1/1971 | Yorty | 294/150 X |
| 3,675,834 | 7/1972 | Peters | 294/149 |
| 4,091,976 | 5/1978 | Morse | 294/153 X |
| 4,730,863 | 3/1988 | Guadnola | 294/156 |
| 4,824,156 | 4/1989 | Greene | 294/142 |
| 5,131,707 | 7/1992 | Zazzara et al. | 294/153 X |

*Primary Examiner*—Johnny D. Cherry
*Attorney, Agent, or Firm*—Paul H. Gallagher

[57] ABSTRACT

A tubular handle, a tubular main loop and a tubular connector piece together form a continuous loop threaded through the handle. A tubular slide lock is fitted over a mid-section of the main loop which is fitted together to form a double strand. All of the foregoing parts are of flexible plastic. In one form, the handle, and the continuous loop are all segments cut from a continuous aggregate source, and in a second form, the slide lock is also a segment cut from a continuous aggregate source.

7 Claims, 1 Drawing Sheet

12
24
16
2
14

20
30
16

4
18
22
20
4

18
22
20

24
31
26

20
26
28
31
24

36
33

18
20
20a
32
22
20b
20
32
26
31
24
28
25
5
5
20
30
16

CLOTHING CARRIER

BACKGROUND OF THE INVENTION

The device of the present invention is adapted particularly for carrying hangers for clothing, commonly known as coat hangers. Such coat hangers most often have a wire hook for carrying them and hanging them, and very often they are uncomfortable to hold in the hand. This is particularly so in the case of a number of hangers, or plurality of them, to be held together in the hand. In the latter case, the hooks of the hangers often do not lie in the same orientation, but assume a somewhat irregular bundle or stack with raw pointed ends exposed which often engage the hand of the holder in an uncomfortable or painful attitude.

SUMMARY OF THE PRESENT INVENTION

The clothing carrier of the present invention is designed for overcoming the above objections, and accommodating a plurality of hangers, as well as a single hanger.

The device is comfortable to the hand of the user.

The device is simple and inexpensive, this being exemplified particularly in that it is made entirely of plastic material, and in at least one form made up of pieces in the form of lengths that are cut from aggregate supplies.

Still a further advantage of the present device is that it is entirely flexible and pliable and can be folded easily, and comfortably carried in the hand or in the pocket, when it is not in use.

BRIEF DESCRIPTIONS OF THE INDIVIDUAL FIGURES OF THE DRAWINGS

DETAILED DESCRIPTION OF THE DRAWING

Figures 1, 2, 3, 4, 5, 6, 7, 8:
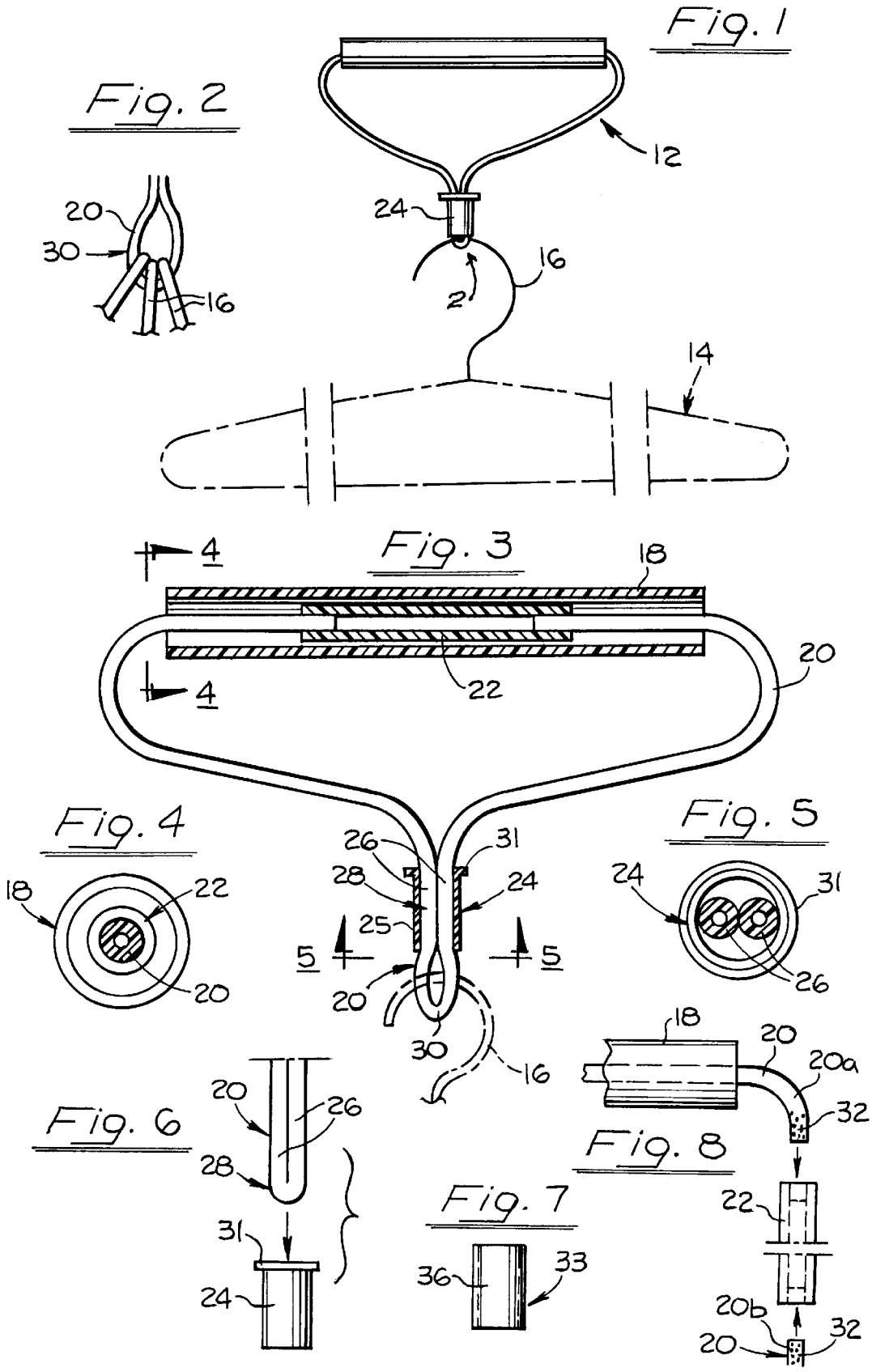
FIG. 1 is an elevational face view of the clothing carrier of the invention, shown in association with a coat hanger, the latter being shown in dot-dash lines.
FIG. 2 is a fragmentary view of a portion of FIG. 1, indicated by the arrow 2, showing a plurality of coat hangers held by the carrier.
FIG. 3 is a sectional view of the device, oriented to FIG. 1.
FIG. 4 is a view taken at line 4—4 of FIG. 3.
FIG. 5 is a view taken at line 5—5 of FIG. 3.
FIG. 6 is a fragmentary view of the lower portion of FIG. 3 with the elements thereof in slightly different position.
FIG. 7 shows an alternate form of slide lock.
FIG. 8 is an exploded view of certain of the elements of the device, showing a step in assembling them.

The device is shown in its entirety at 12, and in FIG. 1 is shown in association with a hanger 14 for clothing, commonly known as a coat hanger. The coat hanger is provided with the usual hook 16, which will be referred to again in connection with hanging of the coat hangers in the carrier.

FIG. 2 shows a carrier holding a plurality, e.g. three, coat hangers, represented by hooks 16. These hooks do not lie flat against each other, and as a consequence they would not be comfortable when held in the hand.

The device 12 includes a handle 18, a main loop 20, a connector piece 22, and a slide lock 24, and is made up entirely of only these parts.

All of the forgoing parts of the device are made of plastic materials which are flexible and pliable, and furthermore, in one form of the device, each is constituted by a length or segment cut from an aggregate source of material. Each of the pieces is therefore uniform in construction throughout its length.

The handle 18 is tubular and in one practical example, is ½" OD and ⅜" ID, and approximately 4" long. These dimensions may vary according to different circumstances. The handle is of simple tubular shape, without end pieces, and remains open at its ends in the completed device.

The main loop 20 is a linear strand made up of a length of tubular, clear, flexible PCV (vinyl) material. Its length may vary, but a practical example is 11 "—" in length, and ⅛" OD, and 1/16 ID, but other dimensions may be utilized instead, according to overall sizes desired. Various dimensions may be varied for other reasons, such as using materials of different thicknesses, where relative ID and OD dimensions would vary.

The connector piece 22 is also a tubular length of clear plastic material. It is designed and dimensioned for receiving in the ends thereof, the terminal ends of the main loop 22. For securing the main loop 20 to the connector piece 22, attention is directed to FIG. 8. For this step, one end 20*a* of the strand of the main loop is inserted through the handle 18 and extended to the exterior at the far end. The connector piece 22 is positioned adjacent that other end, and the other end 20*b* of the strand is adjacent the opposite end of the connector piece.

An adhesive material, such as that known as "Weld-On" is applied to the ends 20*a*, 20*b*, of the strand of the main loop as indicated at 32, and then those ends are inserted into the open ends of the connector piece 22.

This adhesive material soon solidifies, and bonds or fuses the respective elements together. This bonding produces great strength, and the ends of the main loop are held in the connector piece (FIG. 3) notwithstanding the fact that the pressure exerted by the load of the garments on the elements of the main loop, is directed longitudinally outwardly from each other, and from the connector piece.

For identification purposes, the main loop 20 and the connector piece 22 together form a circumferentially continuous loop, and this continuous loop including the connector piece, is slidable in and through the handle.

The slide lock 24 similarly is a flexible plastic tubular piece. The slide lock may be of suitable size, such as 11/16" in length and is dimensioned for receiving doubled pieces 26 (FIG. 3) of the strand of the main loop 20. The latter is ⅛" as noted, and therefore the ID of the slide lock is made slightly less than ¼" (FIG. 5) so as to produce a friction engagement with the two side-by-side strand elements. This friction engagement is for the purpose of producing a locking effect as referred to below.

The strand making up the main loop 20, at a mid-point of the length thereof, has the elements 26 fitted together as referred to, forming a shank 28 which is inserted into the slide lock as indicated in FIG. 6, and extended therethrough as indicated in FIG. 3 to form a locking loop 30 (FIGS. 2, 3) into which the hooks 16 of the coat hangers are inserted. After the coat hanger loops are so inserted in the hooking loop, the slide lock 24 (FIG. 1) is manually slid down the shank 2 into engagement with the coat hanger hooks, for securing the latter therein, against accidental displacement, in normal use.

The parts 18, 20, 22 are cut as lengths from aggregate supplies, which renders the device extremely simple and inexpensive to manufacture. All of the pieces also are tubular, utilizing less total mass in their makeup, this adding a further point of simplicity and reduced expense.

The slide lock 24 may be a presently known article, such as that used on a Bolo tie, and includes a main cylindrical portion 25 and an external circumferential bead 31, the latter facilitating gripping by the fingers.

FIG. 7 shows an alternate form of slide lock 33 that may be used instead of the slide lock 24. In this case, FIG. 7, the slide lock is constituted by a simple cylindrical member 36, of flexible plastic material, without the bead 31, which also may be cut from an aggregate supply. Accordingly each part of the device is uniform in construction throughout its length.

The device is well adapted for imprinting information on the handle 18, such as promotional material, and advertising.

The parts of the device may be of different colors, providing an added attraction.

The entire device may be used as a promotional item, for and issued by organizations such as motels, public laundering shops, as well as other places. Industrial and commercial establishments may also be users of the device, in carrying not only clothes, but other items, such as bags, as well. A main convenience is that while the device is ordinarily held by the hand, it can be used in hanging the entire load, i.e. clothes, for example, in placing the clothes in an automobile, the entire carrier may itself be used as a hanger, and hung on a hook in an automobile intended for such purposes.

The handle 18 has a certain degree of flexibility, being sufficiently flexible to shape to the hand while carrying it, but while not in use, it assumes its straight form, which is semi-rigid, for maintaining the device in proper shape for easily handling it.

The entire device, as noted above, is made up entirely of flexible plastic materials, and the consequently flexible device itself can be easily handled and carried in the hand or the pocket without irritation or annoyance.

Additionally, in the form containing the slide lock of FIG. 7, the entire device is made up of only lengths cut from aggregate supplies.

We claim:

1. A clothing carrier for use with hangers having hooks thereon, comprising, a handle including a substantially straight tubular segment of uniform construction throughout its length, a main loop made up of a linear strand, and being of tubular form and flexible, a connector piece of tubular form, the linear strand of the main loop having its ends telescoped into the connector piece and secured thereto, thereby forming a continuous loop of the main loop and the connector piece, the continuous loop extending slidably through the handle, the main loop having a doubled segment forming a shank exterior to the handle that is compressed with segments thereof in mutually juxtaposed position, and a tubular slide lock slidably telescoped on the shank forming a hooking loop beyond the slide lock relative to the handle, the hooking loop being adapted to receive the hooks of the hangers, and the slide lock being capable of being slid against the hooks for retaining the hooks in the hooking loop.

2. A clothing carrier according to claim 1 wherein, the handle, the main loop, and the connector piece, are constituted entirely by cut-off lengths from respective greater lengths of aggregate material.

3. A clothing carrier according to claim 2 wherein, the slide lock is also constituted entirely by a cut-off length from a greater length of aggregate supply, and each of the handle, main loop, connector piece, slide lock, is of uniform construction throughout its length.

4. A clothing carrier according to claim 1 wherein, the connector piece is of greater diameter than the linear strand of the main loop, and the ends of the linear strand of the main loop and the connector piece are secured together by adhesive material which is operable for welding the material of the main loop and of the connector piece together, thereby forming an effectively integral, one-piece circumferentially continuous loop of the connector piece and main loop.

5. A clothing carrier according to claim 1 wherein, the slide lock is constituted by a tubular, integral one-piece member dimensioned for frictional engagement with the shank.

6. A clothing carrier according to claim 1 wherein, the:

handle, main loop, connector piece, slide lock, are all of plastic material.

7. A clothing carrier according to claim 1 wherein, the:

handle,
main loop,
connector piece,
slide lock, are flexible, the handle remains open ended, and the main loop, with the connector piece, is slidable through the open ends of the handle.

* * * * *